United States Patent [19]

Beton

[11] 4,196,834

[45] Apr. 8, 1980

[54] NOISE REDUCER FOR POWDER ACTUATED FASTENING TOOL

[75] Inventor: Richard J. Beton, South Blackburn, Australia

[73] Assignee: Olin Corporation, New Haven, Conn.

[21] Appl. No.: 968,222

[22] Filed: Dec. 11, 1978

[51] Int. Cl.[2] ..... B25C 1/14

[52] U.S. Cl. ..... 227/10; 60/635

[58] Field of Search ..... 227/9-11; 173/134, 135, 137; 89/14 D; 60/632-638

[56] References Cited

U.S. PATENT DOCUMENTS

| | | | |
|---|---|---|---|
| 3,204,400 | 9/1965 | Kvavle | 227/10 |
| 3,297,224 | 1/1967 | Osborne | 227/10 |
| 3,743,048 | 7/1973 | Bakoledis | 181/53 |
| 3,860,161 | 1/1975 | Engstrom | 227/10 |
| 3,895,752 | 7/1975 | Hatayama et al. | 227/10 |

*Primary Examiner*—John McQuade

*Attorney, Agent, or Firm*—William W. Jones; Paul J. Lerner

[57] ABSTRACT

A noise reducer for a powder actuated fastening tool comprises a barrel including inner and outer cylindrical walls which are radially spaced to define a gas expansion chamber between them. The chamber is adapted to receive combustion gases through ports or passages in the inner wall, and the gases may be exhausted from the chamber in any appropriate manner, preferably at a location adjacent the front end of the tool. The outer wall of the barrel can thus be made to slidingly fit within the tool receiver, while porting of the expansion chamber can be such as to induce a favorable flow pattern to the combustion gases passing therethrough.

5 Claims, 5 Drawing Figures

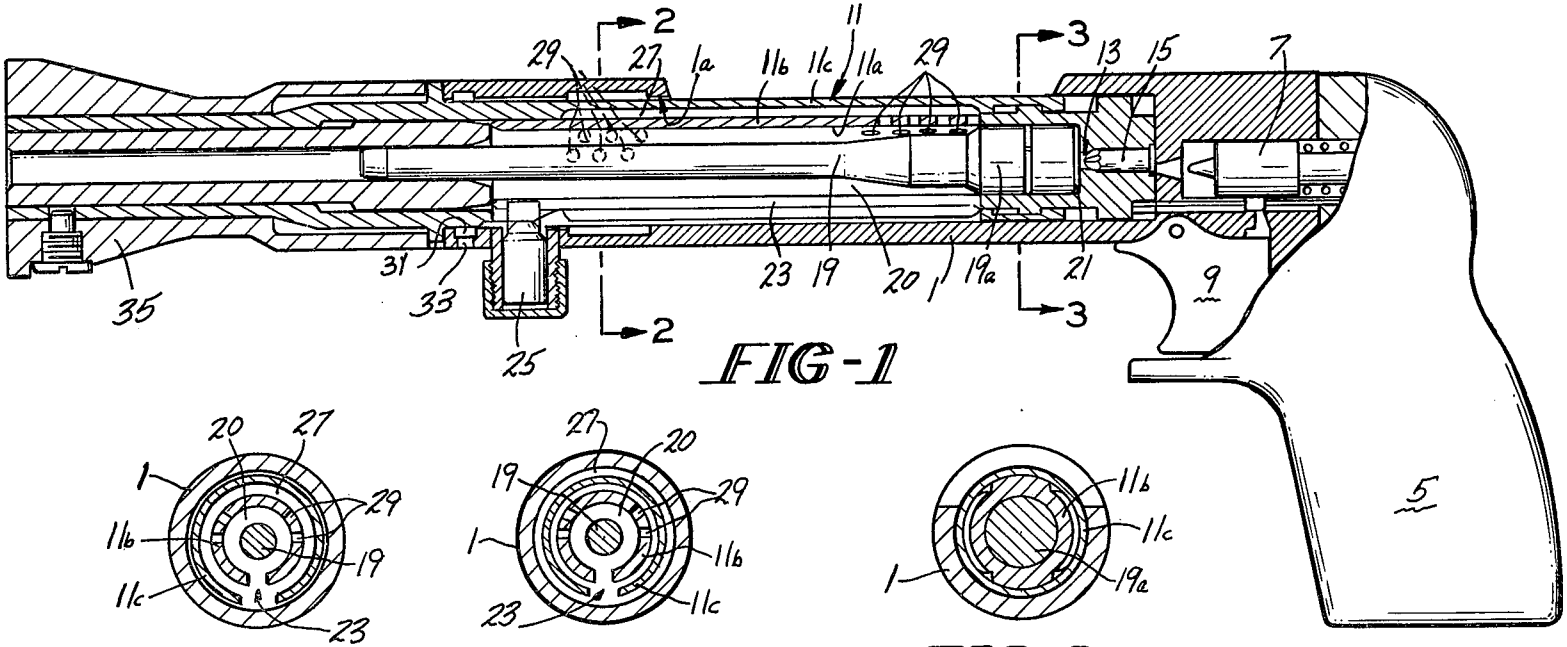
FIG-1
FIG-3
FIG-2
FIG-5
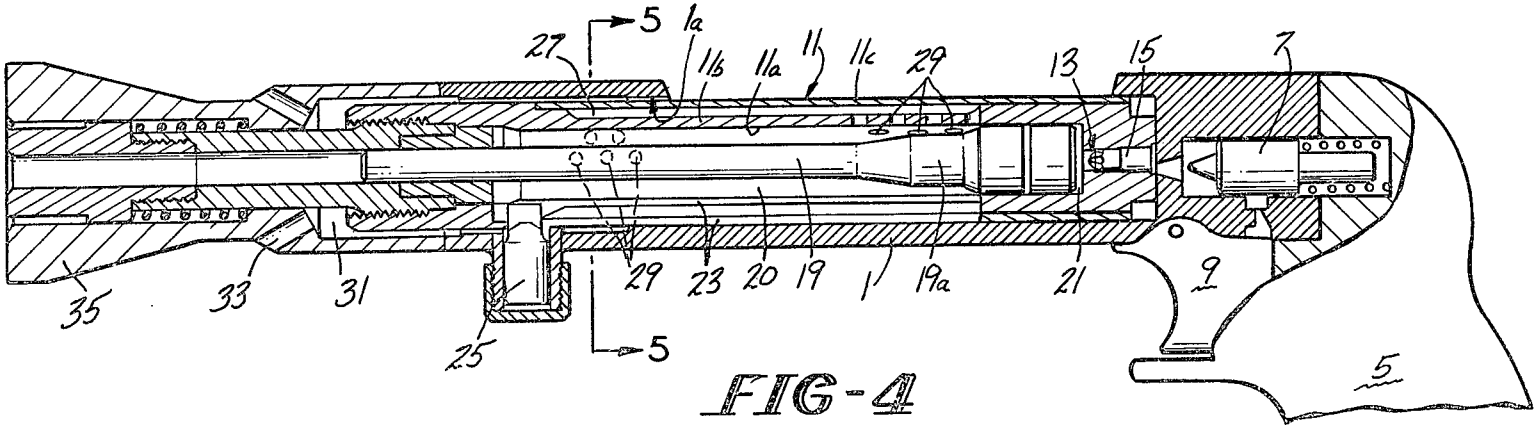
FIG-4

NOISE REDUCER FOR POWDER ACTUATED FASTENING TOOL

FIELD OF THE INVENTION

This invention relates to powder actuates tools of the kind used for driving fasteners or the like into a solid base or support—e.g., timber, concrete, or metal. In particular, the invention is concerned with such tools having a piston arranged to drive the fastener in response to detonation of an explosive charge.

BACKGROUND

Tools of the aforementioned kind have been found objectionable because of the excessive noise generated by detonation of the explosive charge. In some instances that noise is close to the threshold of pain. Attempts to meet that problem have not been successful for various reasons. A major difficulty arises from the conflicting requirements of noise suppression and the need for clearance space at the combustion zone to avoid deleterious build-up or residue. With regard to the last point, it is important to avoid build-up of combustion by-products (residue) between the working surfaces of the tool which might have the result of causing the tool to jam, as that can be hazardous to the user. If the clearance between working surfaces is increased to minimize the danger of jamming, it naturally follows that noise suppression will also be minimized. That is, the relatively large clearance allows a large volume of combustion gas at high pressure to issue from the tool at the one instant so that an intensely loud noise is generated.

PRIOR ART

U.S. Pat. No. 3,743,048 (Bakoledis) discloses one particular construction aimed at achieving noise suppression. In that construction a slidable sheath is provided around the tool barrel so as to form a chamber into which the combustion gas can vent. The theory is that venting of the gas over a relatively large area within the tool reduces the noise inducting pulse. A fault with that construction however, is that the combustion gases must pass around the working surfaces of the tool barrel, which reciprocates during operation, and consequently deposition of residue on those surfaces occurs to the extent that reciprocation of the barrel can be severely retarded. Furthermore, the outer sheath inhibits introduction of the explosive charge, and also inhibits the use of fastener feeding devices such as strip magazines for automatically feeding fasteners in sequence into the tool.

U.S. Pat. No. 3,860,161 (Engsterom) attempts to achieve noise suppression by providing a pocket integral within the tool body and into which the combustion gases can expand following detonation of the charge. Since the combustion gases will follow the path of least resistance, it is necessary in this construction to provide a close fit between the barrel and the tool body so as to inhibit the escape of gas through the top of the charging zone. As a result, there is a substantial danger of the barrel jamming through deposition of residue or other foreign material on the sliding surfaces.

SUMMARY OF THE INVENTION

It is an object of the present invention to provide a tool of the kind indicated which achieves noise suppression without a consequent increase in the danger of jamming.

A further object of the invention is to provide a tool of the foregoing kind which is of relatively simple construction and does not inhibit introduction or explosive charges and/or fasteners.

In accordance with the invention, a barrel for a tool of the kind indicated includes an inner and outer cylindrical wall which are radially spaced to define a gas expansion chamber between them. That chamber is adapted to receive combustion gases through ports or passages in the internal wall, and the gases may be exhausted from the chamber in any appropriate manner, preferably at a location adjacent the front end of the tool. With such an arrangement, the outer wall of the barrel can be made a relativey neat sliding fit within the receiver body of the tool. Also, porting of the expansion chamber can be such as to induce a favourable flow pattern to the combustion gases passing through that chamber.

The invention can be applied to fastening tools of various kinds, but it will be convenient to hereinafter describe the invention with particular reference to one kind of tool which will be identified as typical. It is important to appreciate that the invention is not limited to use in that typical tool construction.

DESCRIPTION OF THE DRAWINGS

FIG. 1 is a side view, partly in cross-section, of a tool incorporating a noise reducer in accord with the present invention.

FIG. 2 is a cross-sectional view taken along line 2—2 of FIG. 1.

FIG. 3 is a cross-sectional view taken along line 3—3 of FIG. 1.

FIG. 4 is a side view, partly in cross-section, of a second tool incorporating a noise reducer in accord with the present invention.

FIG. 5 is a cross-sectional view taken along line 5—5 of FIG. 4.

DESCRIPTION OF THE PREFERRED EMBODIMENT

A typical tool to which the invention can be applied includes a main body or receiver 1 having a cylindrical bore 1*a* formed through one end, and a handle or grip 5 provided at its opposite end. A spring influenced firing pin 7 is slidably mounted in the handle end of the receiver 1, and is selectively releasable by a trigger device 9 so as to project into the bore 1*a* through the adjacent closed end of that bore. A barrel 11 is slidably mounted in the receiver bore 1*a* for movement between a loading position and a cocked position (ready to fire), and has a charge receiving cavity 13 in the end adjacent the closed end of the receiver bore. When the barrel is in the loading position, it is located forwardly relative to the receiver so that a charge can be introduced into the aforementioned cavity through a window provided in an upper surface of the receiver. In the cocked position, the barrel 11 is located at its rearmost position so that the charge 15 is able to be struck by the firing pin 7 upon actuation of the trigger device 9. Spring means is generally provided to hold the barrel 11 at a relaxed position located between the loading and cocked positions, and which is such that the charge 15 cannot be detonated by inadvertant actuation of the trigger device 9.

A drive piston 19 is sidably mounted in a bore 11*a* of the barrel 11, and a combustion chamber 21 is provided between a head portion 19*a* of that piston 19 and the end wall of the barrel 11 containing the charge receiving cavity 13. The piston 19 is of reduced diameter forward of the head portion 19*a* and thereby provides a clearance space 20 for receiving combustion products. Combustion products reach that clearance space 20 by way of a retractor slot 23 formed through the lower wall of the barrel 11 and which communicates directly with the combustion chamber 21 when the piston head 19*a* has moved a short distance towards the front end of the tool from the cocked position.

Tools of the foregoing kind are well known so that further detail as to their construction and manner of operation is not considered necessary. Save to say however, that the retractor slot 23 slidably receives a pawl 25 mounted on the underside of the receiver and which is operative to provide a forward limit stop for the barrel 11, and also functions to relocate the piston 19 which its head 19*a* near the charge receiving cavity 13 when the barrel 11 is moved into the loading position.

When a tool as described is modified to incorporate the present invention, the barrel 11 may be formed as a double wall construction so that a gas expansion chamber 27 is defined between radially inner 11*b* and outer 11*c* walls of that barrel 11. Since the piston 19 is located within the inner wall 11*b* of the barrel 11 it is necessary to form a retractor slot 23 in both walls if the pawl 25 is to function to relocate the piston 19 as previously described. As a result, there is communicaton between the expansion chamber 27, and the annular clearance space 20 surrounding the piston 19. It is preferred to provide an additional means for communication by way of ports 29 formed through the inner wall 11*b* at the side remote from the retractor slot 23 and at a location adjacent the rearward end of the barrel 11. The number and arrangement of those ports 29 can be determined so as to promote a desired gas flow pattern as hereinafter described.

Gas may escape from the expansion chamber 27 through a plurality of ports 29 located adjacent the forward end of the barrel 11. For example, a group of such ports 29 may be provided through the inner wall 11*b* on each side of the barrel. Those ports 29 return the gas into the clearance space 20 around the piston 19, and escape of gas from that space to atmosphere may be achieved through one or more appropriate passages at the front end portion of the tool. In one arrangement, the gas escape path includes in turn, the aforementioned retractor slot 23, a clearance between the outer wall 11*c* of the barrel 11 and the receiver body 1 forwardly of the pawl 25, a compartment 31 in a front end portion of the receiver body 1, and at least one passage 33 formed through a wall of the receiver 1 and communicating with atmosphere. The aforementioned compartment 31 may be defined between a front end portion of the receiver body 1 and a surrounding shield 35, which functions in a known manner.

With the construction described, the outer wall ll*c* of the barrel 11 can be a neat sliding fit within the receiver bore 1*a*, at least for a part of that bore forwardly of the charging window. As a result, the noise suppression capability of the tool is significantly enhanced. Such a neat fit is possible because, with the arrangement described, there is no dumping of residue on working surfaces of the tool during combusion. Furthermore, if desired, the barrel outer wall 11*c* can be constructed so as to resiliently expand in response to detonation of the charge 15 and thereby momentarily create a substantially gas tight seal between it and the receiver 1. Such a seal prevents exhaust of gas through the charging window, which can be unpleasant to the user, and also assist in maintaining sufficient initial pressure within the tool to achieve substantially complete burning of the charge 15.

When the tool is used, detonation of the explosive charge 15 drives the piston 19 forward, and after the piston 19 has travelled a short distance combustion products are able to escape from the combustion chamber 21 by way of the retractor slot 23. In that respect, the operation is no different to prior tools of the general kind described. As there is little space (if any) between the outer surface of the barrel 11 and the surrounding bore surface of the receiver 1, the gas will tend to move in the path of least resistance created by the expansion chamber 27 and its associated ports 29 and passages 33. Some of the gas will travel forwardly along the retractor slot 23 for direct exhaust through the front end portion of the barrel 11, but a substantial part of the gas will be induced upwardly into the expansion chamber 27 because of the substantial space available for release of pressure. The location of the barrel exhaust ports 29 is such that gas within the expansion chamber 27 will be encouraged to move in a spiral path towards the front end of the tool. The resulting extension of the length of the path of travel for the gas naturally increases the total pressure reduction and thereby reduces the level of the noise generated by the charge detonation.

Since the combustion gases are vented through a plurality of chambers and interconnecting ports or passages, a series of pressure impulses are generated in distinction to the single high pressure impulse usually generated in prior tools. As a result, the noise generated by the detonation is significantly reduced. Nevertheless, sufficient pressure is maintained within the tool to ensure combustion of powder not burnt during the actual detonation process.

Residue is dumped through the retractor slot 23 and/or in the expansion chamber 27, and in both cases there is no adverse effect on firing procedure. That is in sharp contrast to prior constructions in which residue is dumped on one or more of the critical working surfaces of the tool.

A further advantage of the construction described is that effective noise suppression is achieved without disturbing the charge loading facility of the tool. As previously mentioned, the construction particularly described is an example construction only. For example, more than one expansion chamber 27 may be provided, and those chambers may be arranged concentrically and/or in axially offset relationship. Furthermore, the invention may be applied to a tool having automatic strip loading of charges, rather than manual loading of individual charges through a window as described.

Two possible embodiments of the invention are shown in the attached drawings, but the particularity of those drawings is not to be understood as superseding the generality of the preceding description.

Finally, it is to be understood that various alterations, modifications and/or additions may be introduced into the constructions and arrangements of parts previously described without departing from the spirit or ambit of the invention.

I claim:

1. An improved powder actuated tool of the type comprising a receiver having a handle at one end and a blind cylindrical bore, a barrel, including a charge-receiving cavity and an axial bore, slidably mounted in said receiver bore for movement between a loading position and a cocked position, said barrel having said charge-receiving cavity in the end thereof nearer said receiver handle, a spring influenced firing pin slidably mounted in the handle end of said receiver and selectively releasable by a trigger device, a drive piston slidably mounted in said barrel bore and a pawl mounted on the underside of said receiver and projecting into a retractor slot formed in said barrel, the improvement comprising: said barrel including at least two radially spaced cylindrical members defining an expansion chamber therebetween, all but the outermost of said barrel members being provided with passage means adapted for the passage of combustion gases radially therethrough, said passage means comprising a plurality of ports formed in all but said outermost barrel member at a first location adjacent the end of said barrel nearer said receiver handle, on the side thereof remote from said retractor slot.

2. The tool of claim 1, wherein said passage means further comprises a plurality of ports formed in all but said outermost barrel at a second location adjacent the end of said barrel remote from said receiver handle.

3. The tool of claim 1 further comprising a compartment defined in the front end of said receiver, said compartment being connected with said retractor slot through a clearance between said barrel and said receiver forward of said pawl, and at least one passage, formed in said receiver, communicating between said compartment and the atmosphere.

4. The tool of claim 1, wherein said ports at said second location are disposed on both sides of said barrel.

5. The tool of claim 1, wherein the outermost barrel member is resiliently expandable, in response to detonation of a charge in said charge-receiving cavity, to momentarily create a gas-tight seal between said outermost barrel member and said receiver.

* * * * *

UNITED STATES PATENT OFFICE

CERTIFICATE OF CORRECTION

Patent No. 4,196,834 Dated April 8, 1980

Inventor(s) Richard J. Beton

It is certified that error appears in the above-identified patent and that said Letters Patent are hereby corrected as shown below:

Col. 1, line 4;

"actuates", should read --actuated--.

Col. 3, line 19;

"which", should read --with--.

Col. 3, line 42;

After "11b", insert omitted portion --of the barrel 11--.

Signed and Sealed this

*Twenty-first* Day of *July 1981*

[SEAL]

*Attest:*

GERALD J. MOSSINGHOFF

*Attesting Officer*

*Commissioner of Patents and Trademarks*